US005473243A

United States Patent [19]

Thomas

[11] Patent Number: 5,473,243

[45] Date of Patent: Dec. 5, 1995

[54] INTEGRATABLE CURRENT SOURCE CIRCUIT FOR GENERATING AN OUTPUT CURRENT PROPORTIONAL TO AN INPUT CURRENT

[75] Inventor: Volker Thomas, München, Germany

[73] Assignee: Siemens Aktiengesellschaft, Munich, Germany

[21] Appl. No.: 183,033

[22] Filed: Jan. 18, 1994

[30] Foreign Application Priority Data

Jan. 27, 1993 [DE] Germany ..... 43 02 221.9

[51] Int. Cl.[6] ..... G05F 3/26

[52] U.S. Cl. ..... 323/315; 330/288

[58] Field of Search ..... 323/312, 313, 323/314, 315, 316; 330/288

[56] References Cited

U.S. PATENT DOCUMENTS

| | | | |
|---|---|---|---|
| 3,813,607 | 5/1974 | Voorman | 323/315 |
| 4,462,005 | 7/1984 | Kusakabe et al. | 330/288 |
| 5,157,322 | 10/1992 | Llewellyn | 323/315 |
| 5,164,658 | 11/1992 | Kuwahara | 323/315 |
| 5,311,146 | 5/1994 | Brannon et al. | 330/288 |

FOREIGN PATENT DOCUMENTS

| | | |
|---|---|---|
| 3744756 | 1/1989 | Germany . |
| 2088662 | 6/1982 | United Kingdom . |

OTHER PUBLICATIONS

IBM Technical Disclosure Bulletin, vol. 32, No. 6B, Nov. 1989, p. 14.

Analysis and design of analog integrated circuits, (Gary) 1984, pp. 234–239.

*Primary Examiner*—Peter S. Wong

*Assistant Examiner*—Y. J. Han

*Attorney, Agent, or Firm*—Herbert L. Lerner; Laurence A. Greenberg

[57] ABSTRACT

An integratable current source circuit for generating an output current proportional to an input current includes a first transistor of one conduction type, and second, third and fourth transistors of the other conduction type. Each of the transistors has a base, a collector and an emitter. The first transistor has a current amplification being greater than current amplifications of the second, third and fourth transistors. An input terminal feeds an input current, and an output terminal taps an output current. A current source on one hand is connected to a reference potential and on the other hand is connected to the emitter of the first transistor and to the base of the second transistor. The collector of the second transistor is connected to the reference potential and the emitter of the second transistor is coupled to the base of the third transistor and to the base of the fourth transistor. The base of the first transistor is connected to the collector of the third transistor and to the input terminal. The collector of the fourth transistor is connected to the output terminal. The collector of the first transistor and the emitters of the third and fourth transistors are connected to a supply potential.

3 Claims, 1 Drawing Sheet

INTEGRATABLE CURRENT SOURCE CIRCUIT FOR GENERATING AN OUTPUT CURRENT PROPORTIONAL TO AN INPUT CURRENT

BACKGROUND OF THE INVENTION

FIELD OF THE INVENTION

The invention relates to an integratable current source circuit for generating an output current proportional to an input current.

Such current source circuits typically include current mirrors of the kind which are known, for instance, from a book entitled: Analysis and Design of Analog Integrated Circuits, by Paul R. Gray, published by John Wiley and Sons, 1984, pp. 234–239. In the simplest form of the current mirrors, a diode, or an input transistor wired to make a diode, is triggered in the conducting direction with an input current, and the voltage dropping across the diode triggers an output transistor, by which an output current proportional to the input current is impressed. Improvements to that simple principle of circuitry provide the connection of a resistor in the emitter line of the output transistor or the replacement of the diode by a configuration of two transistors, with the input current being carried through the collector-to-emitter path of one of the two transistors, and the collector and base of the one transistor being connected to the base and emitter of the other transistor, which on its collector side is connected to a supply potential. The voltage for triggering the output transistor is tapped between the emitter and the base of the first transistor.

With such current mirrors, satisfactory results are obtained in integrated circuits when npn transistors are used, since the npn transistors being used typically exhibit high current amplification with little deviation from one another, so that deviations between the output and input currents are kept slight. Conversely, in current sources, pnp transistors are used, and their current amplification is substantially less while their deviation in terms of current amplification is substantially greater from one to another than in npn transistors. Therefore there is a considerably greater difference between the input and output currents, making the overall precision substantially less.

SUMMARY OF THE INVENTION

It is accordingly an object of the invention to provide an integratable current source circuit, which overcomes the hereinafore-mentioned disadvantages of the heretofore-known devices of this general type and which has greater precision even when transistors with low current amplification and major deviation among the current amplifiers are used.

With the foregoing and other objects in view there is provided, in accordance with the invention, an integratable current source circuit for generating an output current proportional to an input current, comprising a first transistor of one conduction type, and second, third and fourth transistors of the other conduction type, each of the transistors having a base, a collector and an emitter, and the first transistor having a current amplification being greater than current amplifications of the second, third and fourth transistors; an input terminal for feeding an input current, and an output terminal for tapping an output current; a current source being connected on one hand to a reference potential and being connected on the other hand to the emitter of the first transistor and to the base of the second transistor; the collector of the second transistor being connected to the reference potential, the emitter of the second transistor being coupled to the base of the third transistor and to the base of the fourth transistor; the base of the first transistor being connected to the collector of the third transistor and to the input terminal; the collector of the fourth transistor being connected to the output terminal; and the collector of the first transistor and the emitters of the third and fourth transistors being connected to a supply potential.

Besides greater precision, it is moreover achieved that even at a low supply voltage, a greater input current range is allowable, and that both the current source generating the input current and the load fed by the output current are connected to a common reference potential.

In accordance with another feature of the invention, there are provided resistors each being connected between the base of a respective One of the second and fourth transistors and the supply potential. A rapid depletion or clearance of the respective base zone when the input current is in a switched or modulated condition is thus attained.

In accordance with a further feature of the invention, there are provided emitter resistors each being connected into the emitter line of a respective one of the third and fourth transistors. The saturation behavior of the third and fourth transistors can be varied with the two emitter resistors.

In accordance with a concomitant feature of the invention, the third and fourth transistors are each formed by a certain number of parallel-connected, identical partial transistors.

Other features which are considered as characteristic for the invention are set forth in the appended claims.

Although the invention is illustrated and described herein as embodied in an integratable current source circuit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
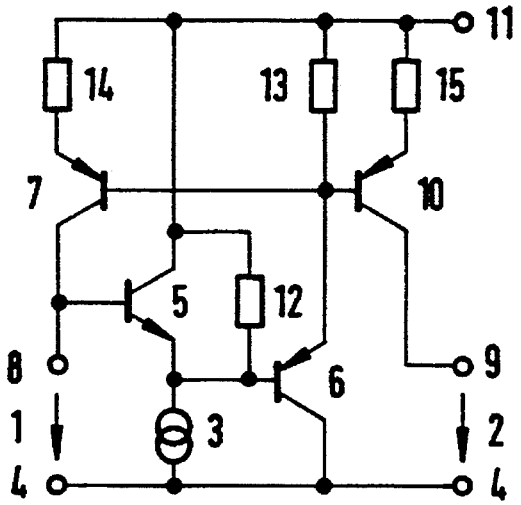
FIG. 1 is a schematic diagram of a general embodiment of a current source circuit according to the invention.

Referring now to the figures of the drawing in detail and first, particularly, to FIG. 1 thereof, there is seen an embodiment in which emitters of two pnp transistors 7 and 10 are each connected to a positive reference potential 11 through a respective resistor 14 and 15. Bases of the two transistors 7 and 10 are coupled to one another and are connected on one hand through a resistor 13 to the positive supply potential 11 and on the other hand directly to an emitter of a pnp transistor 6. The transistor 6 has a collector which is at a reference potential 4 and a base that is coupled directly to an emitter of a npn transistor 5 and is also coupled to the positive supply potential 11 through a resistor 12 and to the reference potential 4 through a constant current source 3. The transistor 5 has a collector which is connected to the positive supply potential 11 and a base that is connected to a collector of the transistor 7 and to a terminal 8, at which an input current 1 is fed that is positive as compared with the reference potential 4. Finally, an output current 2 that is positive as compared with the reference potential 4 can be tapped at a terminal 9, which is connected to the collector of the transistor 10. The transistors 5, 6, 7 and 10 may be considered to be first, second, third and fourth transistors.

In a current source circuit according to the invention, the input current is subtracted from the collector current of the transistor 7, and the resultant differential current is delivered to a first emitter follower stage having the transistor 5 and the current source 3. A second emitter follower stage, which is complementary to the first and has the transistor 6 and the resistor 13, is connected to the output side of the first emitter follower stage, namely to the emitter of the transistor 5. The resistor 13 may also be formed by the input resistors of the transistors 7 and 10. However, to attain rapid depletion or clearance of the base zones for the transistors 7 and 10, the resistor 13 is preferably used. The same purpose is also fulfilled by the resistor 12 for the base zone of the transistor 6. Faster depletion or clearance of the base zones is desirable particularly when the input current 1 is switched or modulated, in order to achieve a higher limit frequency of the current source circuit. The two transistors 7 and 10 are triggered with the output current of the second emitter follower stage. They act as current sources on their own or in combination with the resistors 14 and 15. The input current 1 is subtracted from the collector current of the transistor 7, and the collector current of the transistor 10 forms the output current 2. The collector currents of the transistors 7 and 10 are in a fixed proportion to one another, which is specified by the saturation currents of the two transistors 7 and 10. In order to precisely adjust the saturation currents, the two resistors 14 and 15 may be provided in addition. The saturation currents of the transistors 7 and 10 behave relative to one another like the reciprocals of the respective associated emitter resistors 14 and 15.

The current source circuit according to the invention is especially suitable for integration, since they are allowed to have the low current amplification at the output that is usual in integrated circuitry for realizing current sources with pnp transistors, and the current amplification is allowed to deviate over a wide range. Nevertheless, greater precision is attainable than with the known current mirror circuits, and at relatively low expenditure for circuitry. Moreover, the current source circuits of the invention are distinguished by a lower minimum supply voltage, even though a wide range for the voltage appearing at the output is available. Besides the embodiment described above with a positive supply potential, a current source circuit with a negative supply potential is naturally attainable in the same way, in which pnp transistors are accordingly replaced with npn transistors, and vice versa.

Figure 2:
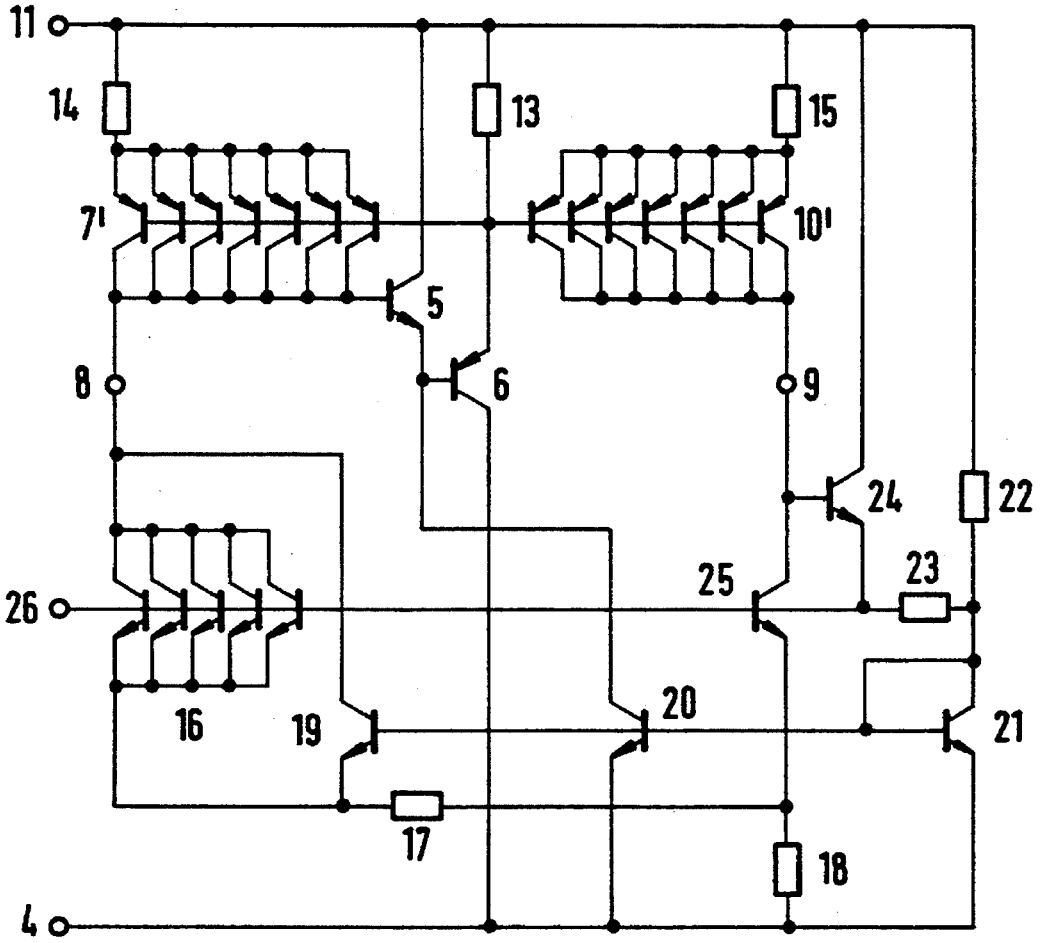
FIG. 2 is a circuit diagram showing the use of a further embodiment in a reference voltage source.

The application of a current source circuit according to the invention in a reference voltage source is shown in FIG. 2. In this case the exemplary embodiment of FIG. 1 is expanded so that an npn transistor 16 which, for instance, includes five parallel-connected partial transistors, is connected on a collector side to the input terminal 8 of the current source circuit and on an emitter side to the reference potential 4, through a voltage divider having two resistors 17 and 18. The collector and the emitter of the transistor 16 are also respectively connected to the collector and the emitter of an npn transistor 19. A base of the npn transistor 19 is connected to bases of an npn transistor 20 and an npn transistor 21. Emitters of the two transistors 20 and 21 are connected to the reference potential 4. The base and a collector of the transistor 21 are connected to one another and are coupled on one hand through a resistor 22 to the positive supply potential 11, and on the other hand through a resistor 23 to the emitter of an npn transistor 24, to the base of an npn transistor 25 and to the base of the transistor 16. The transistor 24 has a collector connected to the positive supply potential 11 and a base connected to the output terminal 9 of the current source circuit. The transistor 25 has an emitter which is connected to the tap of the voltage divider formed of the resistors 17 and 18 and a collector which is also connected to the output terminal 9.

As compared with FIG. 1, the exemplary embodiment of FIG. 2 is also modified in the sense that the current source 3 of FIG. 1 has been replaced by a current mirror including the transistors 20 and 21, so that the collector of the transistor 20 is connected to the emitter of the transistor 5 and the base of the transistor 6. Additionally, pnp transistors 7' and 10', each of which include seven identical partial transistors, also take the place of the transistors 7 and 10.

The reference voltage source shown in FIG. 2 is a so-called bandgap reference, having an output voltage which is adjustable by means of the resistors 17 and 18. The heart of the bandgap reference is the two transistors 16 and 25, having collector currents which are in a fixed proportion to one another, as specified by the current source circuit. However, in the illustrated exemplary embodiment, the collector currents are selected to be equal, and instead the transistor surface areas are made to be in the specified proportion to one another.

The adjustment of the current source circuit is likewise performed through the Subdivision of the area of the transistors 7 and 10 in combination with the resistors 14 and 15. Since the input current and the output current are supposed to be equal, the transistors 7' and 10' each include the same number of identical partial transistors. In addition, the resistors 14 and 15 also affect the saturation behavior of the transistors 7' and 10'. Since the saturation currents of the transistors 7' and 10' in this case behave relative to one another like the reciprocals of the respective associated emitter resistors 14 and 15, it is accordingly true that the resistance of the resistor 14 relative to the resistance of the resistor 15 varies as a function of the relationship between the number of partial transistors of the transistor 10' and the number of partial transistors of the transistor 7'. Since both of these include seven partial transistors each, equal resistances for the resistors 14 and 15 accordingly result. However, depending on the application, arbitrary ratios between the input and output current can also be produced.

The transistors 16 and 25 are triggered by the collector potential of the transistor 25, through the transistor 24 operating as an emitter follower and having an emitter terminal which represents the output of the bandgap reference. The requisite finding of a difference between the collector potential of the transistor 25 and the collector potential of the transistor 16 is carried out through a current source circuit including the resistor 21 which is wired as a diode and the transistor 19 which is connected parallel to the transistor 16. The transistor 20, which is intended to feed the current source circuit, is triggered in combination with the transistor 21. An input current for the diode formed by the transistor 21 is composed on one hand of a current flowing from the supply potential 11 through the resistor 22 into the diode and on the other hand by the current flowing from the emitter of the transistor 24 through the resistor 23 into the diode.

The current source circuit according to the invention thus makes it possible to construct a very precise bandgap reference, which moreover needs only a slight supply voltage. For instance, with a supply voltage of at least 2.4 V, an output voltage of 1.3 V at an output terminal 26 is attainable. This can be done at a relatively low expenditure for circuitry and in particular in integrated circuitry, using a plurality of components of identical construction, it increases the precision of the entire configuration even further.

I claim:

1. An integratable current source circuit for generating an output current proportional to an input current, comprising:

a first transistor of one conduction type, and second, third and fourth transistors of the other conduction type, each of said transistors having a base, a collector and an emitter, and said first transistor having a current amplification greater than current amplifications of each of said second, third and fourth transistors;

an input terminal for feeding an input current, and an output terminal for tapping an output current;

a current source having one terminal connected to a reference potential and another terminal connected to the emitter of said first transistor and to the base of said second transistor; and a resistor connected between the base of said fourth transistor and the supply potential;

the collector of said second transistor being connected to the reference potential, the emitter of said second transistor being coupled to the base of said third transistor and to the base of said fourth transistor;

the base of said first transistor being connected to the collector of said third transistor and to said input terminal;

the collector of said fourth transistor being connected to said output terminal; and the collector of said first transistor and the emitters of said third and fourth transistors being connected to a supply potential, and said third and fourth transistors each being formed of a given number of parallel-connected, mutually identical partial transistors each having commonly connected bases, collectors and emitters.

2. The current source circuit according to claim 1, including a resistor connected between the base of said second transistor and the supply potential.

3. The current source circuit according to claim 2, including emitter lines of said third and fourth transistors, and emitter resistors each being connected into a respective one of said emitter lines.

* * * * *